United States Patent [19]

Marco et al.

[11] Patent Number: 5,072,829

[45] Date of Patent: Dec. 17, 1991

[54] CARRIER STOCK WITH INTEGRAL HANDLES

[75] Inventors: Leslie S. Marco, Bloomingdale; Robert Olsen, Medinah, both of Ill.

[73] Assignee: Illinois Tool Works Inc., Glenview, Ill.

[21] Appl. No.: 669,491

[22] Filed: Mar. 14, 1991

Related U.S. Application Data

[63] Continuation-in-part of Ser. No. 519,858, May 7, 1990.

[51] Int. Cl.[5] ..... B65D 75/56; B65D 71/00

[52] U.S. Cl. ..... 206/162; 206/150; 206/428

[58] Field of Search ..... 206/428, 139, 150, 162

[56] References Cited

U.S. PATENT DOCUMENTS

| | | | |
|---|---|---|---|
| 3,314,712 | 4/1967 | Hohl et al. | 294/87.2 |
| 3,792,562 | 2/1974 | Gilliam | 206/428 |
| 4,356,914 | 11/1982 | Olsen et al. | 206/150 |
| 4,520,924 | 6/1985 | Edwards et al. | 206/150 |
| 4,523,676 | 6/1985 | Barrash | 206/150 |
| 4,624,363 | 11/1986 | Edwards | 206/150 |

*Primary Examiner*—William I. Price

*Attorney, Agent, or Firm*—Dressler, Goldsmith, Shore, Sutker & Milnamow, Ltd.

[57] ABSTRACT

Carrier stock formed from a single sheet of resilient polymeric material, such as low density polyethylene, and severable into individual carriers with integral handles along lateral edges. Integrally joined band segments define container-receiving apertures. Perforate lines, along which such stock is severable, divide certain cross segments into half segments. Each half segment has an aperture-defining edge configured with a nub countering tendencies of such half segment to neck down or to break.

6 Claims, 2 Drawing Sheets

CARRIER STOCK WITH INTEGRAL HANDLES

CROSS-REFERENCE TO RELATED APPLICATION

This application is a continuation-in-part of U.S. Pat. Application Ser. No. 07/519,858 filed May 7, 1990, and assigned commonly herewith, for "Carrier Stock with Integral Handles", the disclosure of which is incorporated herein by reference.

TECHNICAL FIELD

This invention pertains to carrier stock for machine application to substantially identical cans or other containers. This invention pertains, more particularly, to carrier stock that is severable into individual carriers with separate apertures to receive the individual containers, with integral handles, and with nubs to counter tendencies of certain band segments of the carriers to neck down or to break.

BACKGROUND OF THE INVENTION

Typically, carrier stock with individual container-receiving apertures for machine application to substantially identical containers is formed, as by diecutting, from a single sheet of resilient polymeric material, such as low density polyethylene. Typically, such stock is severable transversely, along perforated lines dividing certain band segments into half segments, so as to form individual carriers with separate apertures to receive the individual containers.

As disclosed in U.S. Pat. Application Ser. No. 07/51 858, supra, such stock can be advantageously provided with an integral handle along one lateral edge of each carrier. When a package comprising a number of individual containers (e.g., six, eight, or twelve containers) and such a carrier having such a handle is carried by the handle, certain band segments of the carrier tend to neck down or to break, namely the half segments where the carrier was separated from the preceding and succeeding carriers of the same stock. A perforated line produces stress concentrations, which are exacerbated if a transversely moving plow or other force-transmitting means is forced between the individual carriers. Such a means tends to produce small nicks or width reductions of the half segments.

As disclosed in U.S. Pat. Application Ser. No. 07/519,858, supra, tendencies of certain half segments to neck down or to break can be effectively countered by nubs formed along aperture-defining edges of those half segments, in carrier stock having integral handles joined to other band segments in a manner disclosed therein. This invention stems from an appreciation that such tendencies can be effectively countered by such nubs even if the integral handles are not joined to other band segments in the manner disclosed therein.

SUMMARY OF THE INVENTION

This invention provides carrier stock from a single sheet of resilient polymeric material, such as low density polyethylene, for machine application to substantially identical containers. Such stock is severable to form individual carriers with separate apertures to receive the individual containers and with integral handles. The carrier stock is formed with several characteristic features for each individual carrier.

Thus, for each individual carrier, the carrier stock is formed with integrally joined band segments defining the separate apertures. Such segments include outer segments that extend generally in a longitudinal direction along a first edge of the carrier when the stock is unstressed, outer segments that extend generally in a longitudinal direction along a second edge of the carrier when the stock is unstressed, and cross segments that extend generally in a transverse direction when the stock is unstressed.

Also, for each individual carrier, the carrier stock is formed with an integral handle having two ends. The ends of the integral handle are joined respectively to the outer segments along the first edge. In one contemplated embodiment, each end of the integral handle is joined, at a node, to two of the outer segments along the first edge and to one of the cross segments other than those noted below as divided into half segments.

Selected ones of the cross segments have weakened lines, such a perforated lines, which extend generally in a transverse direction when the carrier stock is unstressed, and which divide the segments having such lines into half segments. Such lines facilitate severance of the carrier stock to form the individual carriers.

Each half segment joined to one of the outer segments along the first edge, along which the ends of the integral handle are joined to outer segments, is configured, preferably with two concave sections and one convex section, so as to define a nub for countering tendencies of such half segment to neck down or to break. It is preferred that each half segment joined to one of the outer segments along the second edge is configured to define a similar nub.

These and other objects, features, and advantages of this invention are evident from the following description of one contemplated embodiment of this invention, with reference to the accompanying drawings.

DETAILED DESCRIPTION OF ILLUSTRATED EMBODIMENT

Figure 1:
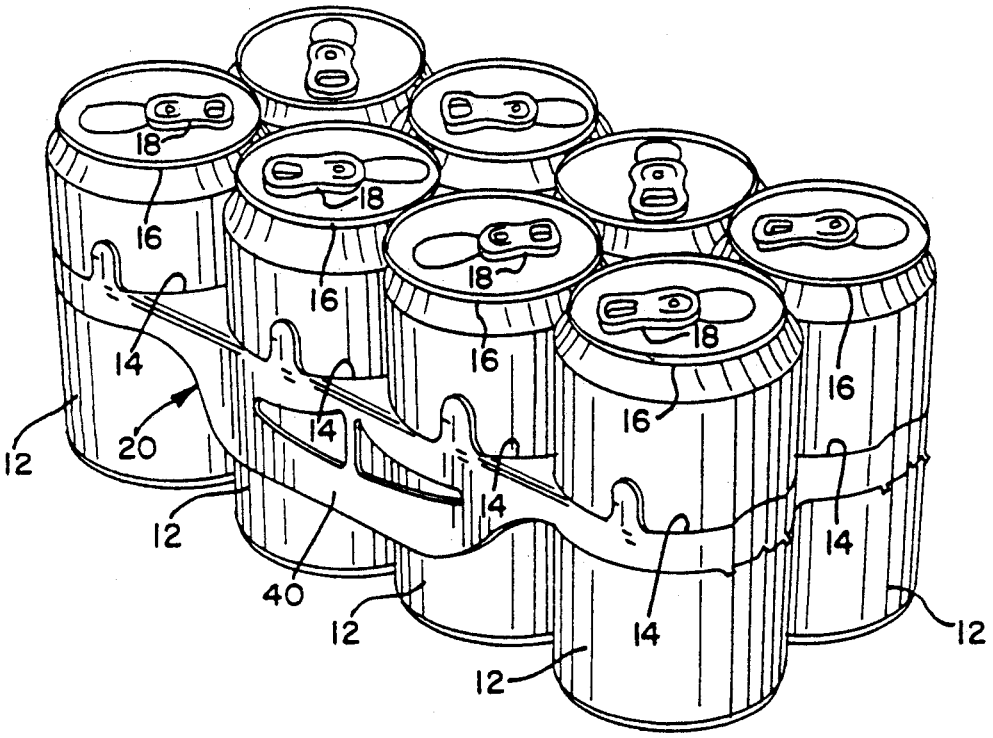
FIG. 1 is a perspective view of a package comprising eight substantially identical containers and a carrier, which is severed from carrier stock according to this invention.
Figure 3:
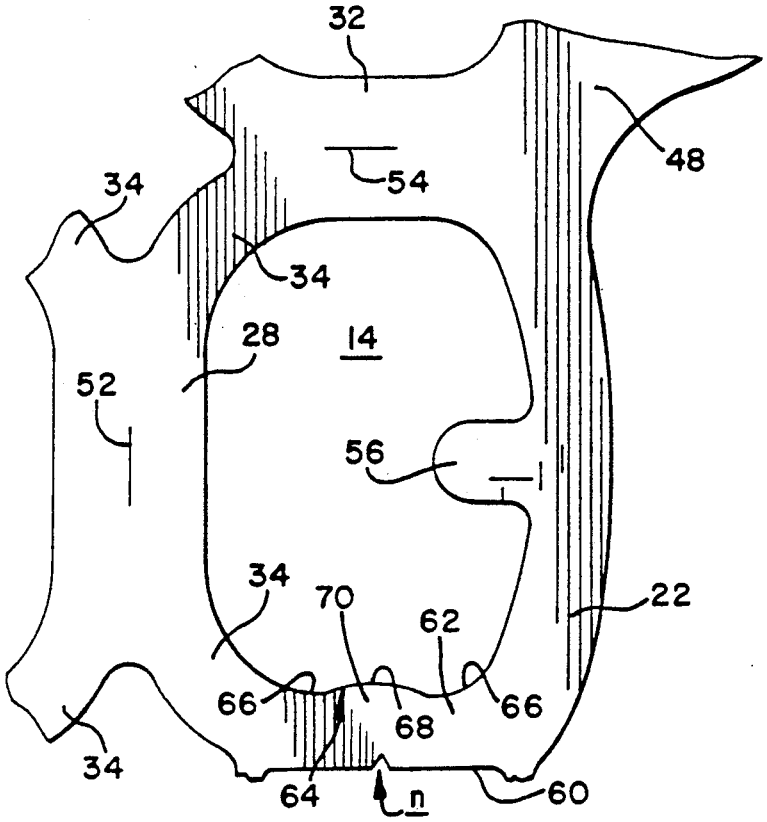
FIG. 3, on a larger scale, is a fragmentary detail showing band segments defining a container-receiving aperture of such stock.
Figure 2:
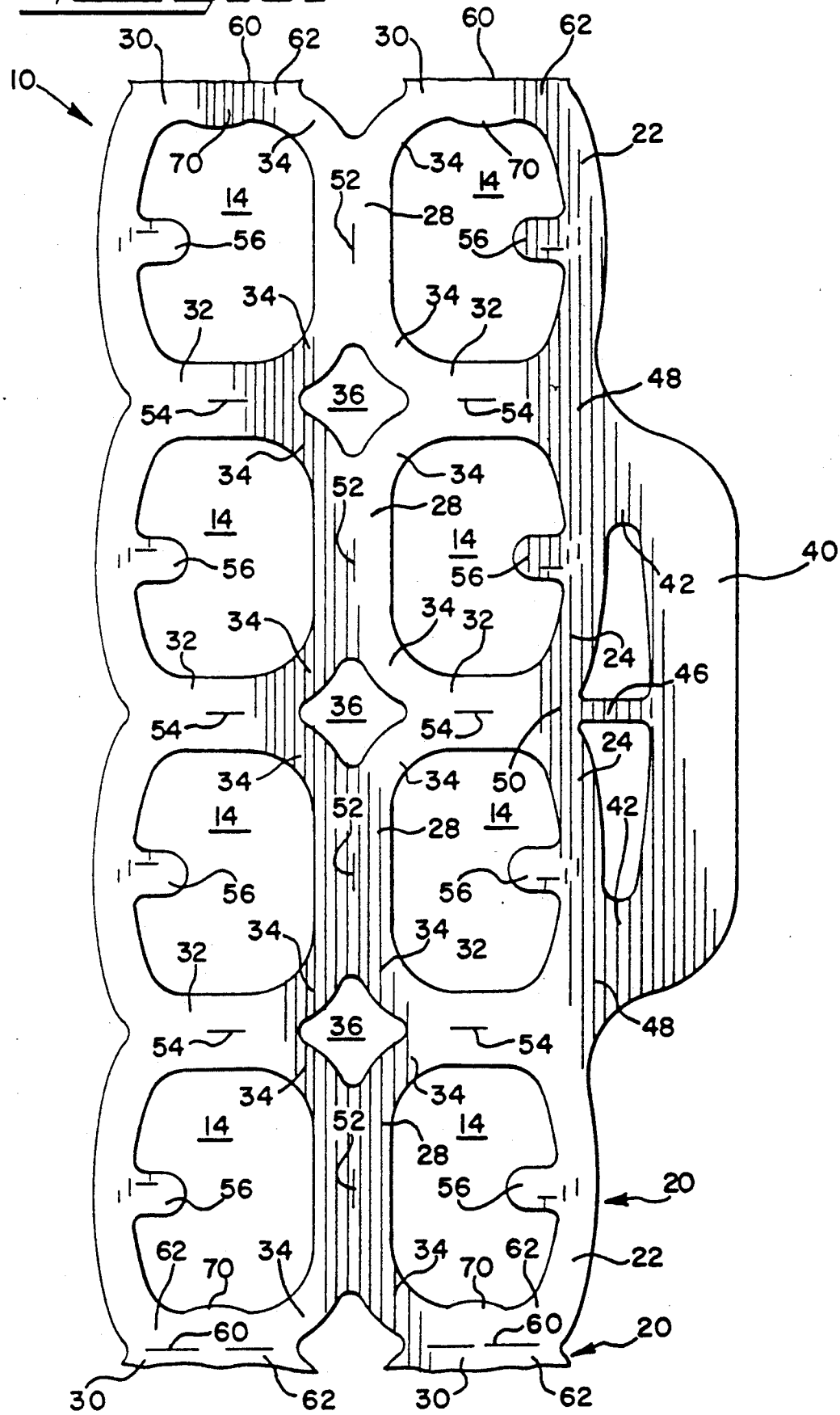
FIG. 2, on an intermediate scale, is a plan view of carrier stock according to a presently preferred embodiment of this invention.

As shown in FIG. 1 through 3, carrier stock 10 for machine application to substantially identical containers 12 constitutes a presently preferred embodiment of this invention. Such stock 10 is formed with separate apertures 14 to receive the individual container 12. The carrier stock 10 is severable, along transverse lines to be later described, to form individual carriers 20 that are substantially identical.

As shown in FIG. 1, the containers 12 are beverage cans of a type used commonly for beer, soft drinks, and other beverages. Also, each container 12 has a chime 16 at one end, which is provided with a pull tab. This invention is not limited, however, to usage with such cans but is useful with cans, bottles, and other containers of various types.

In FIG. 1, a package is shown, which comprises eight such containers 12 and one such carrier 20, as severed from such stock 10. One such carrier 20 is shown fully in FIG. 2, which also shows fragmentary portions of the next carrier 20. Each carrier 20 is shown in an unstressed condition in FIG. 2.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 14 mils.

The carrier stock 10 is formed, for each individual carrier 20, with integrally joined band segments defining eight separate apertures 14. As shown in FIG. 2, such apertures 14 are in a rectangular array with longitudinal rows and transverse ranks, namely two longitudinal rows and four transverse ranks for each individual carrier 20.

The carrier stock 10 is applied to the side walls of the respective containers 12 away from the chime 16 of each container 12. The carrier stock 10 may be applied as the carrier stock disclosed in Klygis U.S. Pat. No. 4,018,331 is applied. A suitable machine for applying such stock 10 is disclosed in Benno et al. U.S. Pat. No. 3,959,949.

An alternate machine, which is adaptable for applying the carrier stock 10 is disclosed in Seymour et al U.S. Pat. application Ser. No. 07/519,860, filed May 7, 1990, and assigned commonly herewith, for "Apparatus and Method for Applying Multi-Package Device".

The band segments defining the separate apertures 14 of each carrier 20 include outer segments that extend generally in a longitudinal direction when the carrier stock 10 is unstressed, namely two outer segments 22 extending along a first edge of such carrier 20 to its respective ends, two outer segments 24 extending along the first edge of such carrier 20 between the outer segments 22, and four outer segments 26 extending along a second edge of such carrier 20. Such band segments include four inner segments 28 that extend generally in a longitudinal direction when such stock 10 is unstressed. Such band segments include cross segments that extend generally in a transverse direction when such stock 10 is unstressed, namely two cross segments 30 at each of the respective ends of such carrier 20 and three pairs of cross segments 32 between the cross segments 30. Such band segments include diagonal segments 34, each of which connects one of the inner segments 28 and one of the cross segments 30, 32, and which define generally diamond-shaped apertures 36 in the carrier stock 10.

Also, along the first edge of each carrier 20, the carrier stock is formed with an integral handle 40 having two outer ends 42 and a middle leg 46. Each of the outer ends 42 is joined, at a node 48, to one of the outer segments 22, one of the outer segments 24, and one of the cross segments 32. The middle leg 46 is joined, at a node 50, to two of the outer segments 24 and one of the cross segments 32. The middle leg 46 may be optionally provided with a generally longitudinal slit (not shown) so as to enable the middle leg 46 to be easily broken by a user manipulating the integral handle 40.

As shown in FIG. 2, the inner segments 28 have generally longitudinal slits 52, and the cross segments 32 have generally transverse slits 54. The slits 52, 54, facilitate folding of the inner segments 28 and the cross segments 32 when the carrier stock 10 is applied to the individual containers 12.

The carrier stock 10 is formed with tear-open tabs 56 conforming essentially to the tear-open tabs disclosed in Marco et al. U.S. Pat. Application Ser. No. 07/537,674 filed June 14, 1990, and assigned commonly herewith, for "Carrier Stock with Tear-Open Tabs", the disclosure of which is incorporated herein by reference. Each tab 56 extends into one of the apertures 14 from one of the outer segments 22, 24, 26. Each tab 56 and the outer segment associated with such tab 56 are slitted in a manner disclosed in U.S. Pat. Application Ser. No. 07/537,674, supra.

In the carrier stock 10, the cross segments 30 at the respective ends of each carrier 20 have weakened, perforated lines 60, which extend generally in a transverse direction when such stock 10 is unstressed, and which divide such segments 30 into half segments 62. The perforated lines 60 facilitate severance of the carrier stock 10 to form the individual carriers 20. Such stock 10 can be manually broken or otherwise severed along such lines 60. Each half segment 62 is partly bounded by one such line 60, which produces stress concentrations in such half segment 62.

The carrier stock 10 can be transversely severed by a transversely mowing plow (not shown) or other force-transmitting means forced between the individual carriers 20. Such a means tends to produce small nicks or width reductions n, one of which is shown in FIG. 3, or other flaws exacerbating stress concentrations in the half segments 62.

As exemplified in FIG. 3, each half segment 62 has an aperture-defining edge 64 with a characteristic shape contemplated by this invention. Specifically, such edge 64 is configured with two concave sections 66 and one convex section 68 between the concave sections 66. Such edge 64 is configured to provide smooth transitions between the concave sections 66 and the convex section 68.

The convex section 68 defines a nub 70, which effectively functions as means for countering tendencies of such half segment 62 when stressed to neck down or to break because of stress concentrations produced by the perforated line 60 that partly bounds such half segment 62. The nub 70 provides a localized region of augmented cross section with smooth transitions to adjacent regions of such half segment 62.

Various modifications may be made in the carrier stock disclosed herein without departing from the scope and spirit of this invention.

We claim:

1. Carrier stock for machine application to substantially identical containers, said stock being formed from a single sheet of resilient polymeric material and being severable to form individual carriers with separate apertures to receive the individual containers and with integral handles, said stock being formed for each individual carrier with (a) integrally joined band segments defining the separate apertures and including outer segments that extend generally in a longitudinal direction along a first edge of the carrier when the stock is unstressed, outer segments that extend generally in a longitudinal direction along a second edge of the carrier when the stock is unstressed, and cross segments that extend generally in a transverse direction when the stock is unstressed, the first edge being opposite to the second edge, and (b) an integral handle having two ends, which are joined respectively to outer segments along the first edge, wherein selected ones of the cross segments have weakened lines extending generally in a transverse direction when said stock is unstressed and dividing the segments having said lines into half segments, said lines facilitating severance of said stock to form the individual carriers, and wherein each half segment joined to one of the outer segments along the first edge has an aperture-defining edge configured so as to define a nub constituting means for countering tendencies of such half segment when stressed to neck down or to break.

2. The carrier stock of claim 1 wherein each half segment joined to one of the outer segments along the second edge has an aperture-defining edge configured so as to define a similar nub.

3. The carrier stock of claim 1 wherein each of the ends of the integral handle is joined, at a node, to two of the outer segments along the first edge and to one of the cross segments other than the cross segments divided into half segments.

4. The carrier stock of claim 3 wherein each half segment joined to one of the outer segments along the second edge has an aperture-defining edge configured so as to define a similar nub.

5. The carrier stock of claim 1 wherein the aperture-defining edge of each half segment joined to one of the outer segments along the first edge is configured with two concave sections and one convex section defining the nub.

6. The carrier stock of claim 2 wherein the aperture-defining edge of each half segment joined to one of the outer segments along the second edge is configured with two concave sections and one convex section defining the similar nub.

* * * * *